US007207355B2

(12) United States Patent
Lee

(10) Patent No.: US 7,207,355 B2
(45) Date of Patent: Apr. 24, 2007

(54) MULTI-AXIAL SEAMED PAPERMAKING FABRIC AND METHOD

(75) Inventor: Henry Lee, Simpsonville, SC (US)

(73) Assignee: AstenJohnson, Inc., Charleston, SC (US)

( * ) Notice: Subject to any disclaimer, the term of this patent is extended or adjusted under 35 U.S.C. 154(b) by 33 days.

(21) Appl. No.: 11/123,442

(22) Filed: May 6, 2005

(65) Prior Publication Data

US 2006/0249221 A1 Nov. 9, 2006

(51) Int. Cl.
*D21F 7/08* (2006.01)
*D21F 7/10* (2006.01)
*D03D 25/00* (2006.01)
*D21F 2/00* (2006.01)

(52) U.S. Cl. ..... 139/383 A; 139/383 AA

(58) Field of Classification Search ..... 139/383 A, 139/383 AA; 162/358.2
See application file for complete search history.

(56) References Cited

U.S. PATENT DOCUMENTS 5,268,076 A * 12/1993 Best et al. ..... 162/358.2
5,360,656 A * 11/1994 Rexfelt et al. ..... 428/193
5,601,120 A * 2/1997 Kuckart et al. ..... 139/383 AA
5,713,396 A * 2/1998 Lee ..... 139/383 A
5,713,399 A * 2/1998 Collette et al. ..... 139/383 AA
5,785,818 A * 7/1998 Fekete et al. ..... 162/358.2
5,916,421 A * 6/1999 Yook ..... 162/358.2
5,939,176 A * 8/1999 Yook ..... 428/193
5,975,148 A * 11/1999 Lee ..... 139/383 A
6,117,274 A * 9/2000 Yook ..... 162/358.2
6,162,518 A * 12/2000 Korfer ..... 428/60
6,265,048 B1 * 7/2001 Rydin et al. ..... 428/121
6,302,155 B1 * 10/2001 Rydin ..... 139/383 AA
6,343,626 B1 * 2/2002 Demey et al. ..... 139/398
6,491,794 B2 * 12/2002 Davenport ..... 162/358.2
H002081 H * 9/2003 Lee ..... 442/181
6,702,927 B2 * 3/2004 Moriarty et al. ..... 162/358.2
6,712,100 B2 * 3/2004 Yook et al. ..... 139/383 A
6,723,208 B1 * 4/2004 Hansen ..... 162/358.2
6,776,878 B2 * 8/2004 Yook ..... 162/358.2
6,837,276 B2 * 1/2005 Josef et al. ..... 139/383 A
6,899,143 B2 * 5/2005 Rougvie et al. ..... 139/383 A
6,953,065 B2 * 10/2005 Martin et al. ..... 139/383 A (Continued)

*Primary Examiner*—Robert H. Muromoto, Jr.
(74) *Attorney, Agent, or Firm*—Volpe and Koenig, P.C.

(57) ABSTRACT

A multi-axial seamed base fabric is provided that is formed from a spirally wound fabric strip having a width less than an overall width of the fabric that is joined together along neighboring adjacent edges of the strip to form a fabric tube. The fabric strip includes a plurality of generally linearly extending vertically stacked pairs of machine direction (MD) warp yarns interwoven with cross-machine direction (CMD) weft yarns in a repeat pattern which maintains the vertically stacked alignment of the paired MD warp yarns. The fabric tube includes an upper layer and a lower layer formed from the spirally wound fabric strip that are adjacent to one another in the base fabric. The ends of the base fabric are formed by CMD folds in the fabric tube, with the MD warp yarns of each of the upper and lower layers being in a generally vertically stacked alignment within both of the layers adjacent to the ends to provide at least some continuously extending ones of the outer warp yarns between the upper and lower layers at the folds. Seaming loops are formed from at least some of the continuously extending ones of the outer MD yarns located at the CMD folds in the fabric tube. A method of producing such a fabric is also provided.

21 Claims, 5 Drawing Sheets

U.S. PATENT DOCUMENTS 7,008,512 B2 * 3/2006 Rougvie et al. ..... 162/348
7,048,012 B2 * 5/2006 Martin et al. ..... 139/383 A
7,059,361 B1 * 6/2006 Hansson ..... 139/383 A
7,114,529 B2 * 10/2006 Johnson et al. ..... 139/383 A

* cited by examiner

MULTI-AXIAL SEAMED PAPERMAKING FABRIC AND METHOD

FIELD OF INVENTION

The present invention is directed to a multi-axial seamed papermaking fabric as well as a base fabric for use as or in connection with various different types of papermaking fabrics. More particularly, the invention relates to a multi-axial seamed papermaking fabric in which the seams are formed from uniformly sized and shaped seaming loops which can be interdigitated and joined by a pintle.

BACKGROUND

On-machine-seamable multi-axial press fabrics for the press section of papermaking machines are known in the art. Such press fabrics are generally made from a base fabric layer assembled by spirally winding a fabric strip in a plurality of contiguous turns which are joined together along neighboring adjacent edges of the strip to form an endless base fabric tube. This tube is then flattened to produce first and second fabric plies or layers which are then joined to one another. A seam is formed by removing cross-direction yarns from each turn of the fabric strip at the folds located at the cross-machine direction (CMD) extending edges of the fabric. This results in a plurality of seaming loops being formed by the folded over generally machine direction (MD) extending yarns in the fabric which can be joined by the insertion of a pintle following the interdigitation of the seaming loops from the opposed fabric ends.

Such arrangements are described in U.S. Pat. Nos. 6,117,274 and 6,776,878. Additionally, in order to achieve a desired void volume, multiple layers of fabric may be joined together. Seaming loops are provided at the ends of the multiple fabric layers and can be joined by interdigitating the seaming loops to form multiple passages through which multiple pintles are then passed.

In addition to the fabrics described in the above-referenced prior art patents, FIGS. 1 and 2 also show a known commercial spiral wound multi-axial base fabric for use in a press fabric for the press section of a papermaking machine. In the known multi-axial on-machine seamable laminated press fabrics, the seams have been problematic due to the unevenness of the folded generally MD extending warp yarns that are used to form the seaming loops. As shown in FIGS. 1 and 2, in a typical arrangement, these MD warp yarns are arranged at non-uniform positions across the fabric thickness, depending upon the weave and the fold location used to form the seam. This results in an uneven path for insertion of the pintle in order to seam the fabric on the paper making machine. This can also result in an unacceptable discontinuity in the fabric at the seam due to fabric tension at the seam being carried in a non-uniform manner based on the various positions of the generally MD extending warp yarns across the height of the fabric.

It would be desirable to provide a base fabric for a multi-axial seamed papermaking fabric as well as a multi-axial seamed papermaking fabric that provides a more uniform seam that can be more easily assembled on papermaking machine with reduced time and cost savings.

SUMMARY

Briefly stated, the present invention is directed to a multi-axial seamed papermaking fabric. The papermaking fabric includes a base fabric formed from a spirally wound fabric strip having a width less than an overall width of the papermaking fabric that is joined together along neighboring adjacent edges of the strip to form a fabric tube. The fabric strip includes a plurality of generally linearly extending vertically stacked pairs of machine direction (MD) warp yarns interwoven with cross-machine direction (CMD) weft yarns in a repeat pattern which maintains the generally vertically stacked alignment of the paired MD warp yarns. The fabric tube includes an upper layer and a lower layer formed from the spirally wound fabric strip that are adjacent to one another in the base fabric, and ends of the base fabric are formed by CMD folds in the fabric tube. The MD warp yarns of each of the upper and lower layers are in generally vertically stacked alignment within both of the layers adjacent to the ends of the base fabric to provide at least some continuously extending ones of the outer warp yarns between the upper and lower layers at the folds. A seam is formed from the at least some of the continuously extending ones of the outer MD yarns located at the CMD folds in the fabric tube.

In another aspect of the invention, preferably a fiber batt material is attached to at least one planar surface of the fabric in order to form a press felt.

In a preferred embodiment, the seam generally comprises a uniform row of seaming loops formed at each of the folds by the continuously extending ones of the outer MD warp yarns between the upper and lower layers at the fold. Preferably, the inner ones of the MD warp yarns at the fold are cut back from the base fabric ends.

In another aspect, the present invention provides a method for forming a spiral wound, multi-axial seamed papermaking fabric. The method includes weaving a fabric strip which includes vertically stacked, paired, generally linearly extending MD warp yarns that are woven with cross-machine direction (CMD) weft yarns in a repeat pattern which maintains the vertically stacked alignment of the MD warp yarns. The fabric strip is spirally wound and joined along linearly adjacent edges of the strip to form a fabric tube having an upper layer and a lower layer. Two generally CMD extending folds are formed in the fabric tube to define ends of a base fabric having the upper layer and the lower layer in contact with one another. The plurality of generally linearly extending MD warp yarns in both of the layers are in a generally vertically stacked alignment adjacent to the ends.

In a preferred method of forming the fabric, at least some of the CMD weft yarns at the fold are removed to expose a continuous extension of outer ones of the MD warp yarns between the upper and lower layers. At least some of the CMD weft yarns at the fold are removed. This forms a generally uniform row of seaming loops at the fold formed by the continuous extension of the outer ones of the MD warp yarns. Preferably at least some of the inner ones of the MD warp yarns are removed at the fold.

In another aspect, the invention provides a base fabric for use in a papermaker's fabric. The base fabric comprises a spirally wound fabric strip having a width less than an overall width of the base fabric, the neighboring adjacent edges of the strip being joined together to form a fabric tube. The fabric strip comprises a plurality of generally linearly extending vertically stacked pairs of MD warp yarns interwoven with CMD weft yarns in a repeat pattern which maintains the vertically stacked alignment of the pairs of MD warp yarns. The fabric tube includes an upper layer and a lower layer formed from the spirally wound fabric strip that are adjacent to one another in the base fabric. Ends of the base fabric are formed by CMD folds in the fabric tube.

The MD warp yarns of each of the upper and lower layers are in generally vertically stacked alignment within both of the layers adjacent to the ends to provide at least some continuously extending outer MD warp yarns between the upper and lower layers at the folds. The seam is formed from at least some of the continuously extending outer MD warp yarns located at the CMD folds in the fabric tube.

BRIEF DESCRIPTION OF THE DRAWING(S)

The foregoing summary as well as the following detailed description will be readily understood in conjunction with the appended drawings which illustrate preferred embodiments of the invention. In the drawings.

DETAILED DESCRIPTION OF THE PREFERRED EMBODIMENT(S)

Figure 1:
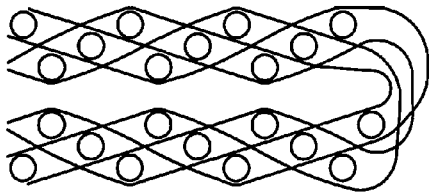
Fig. 1 ( PRIOR ART )
FIG. 1 is a cross-sectional view of a multi-axial seamed papermaking fabric in accordance with the prior art shown at a CMD seam fold.

Certain terminology is used in the following description for convenience only and is not limiting. The words "right", "left", "top" and "bottom" designate directions in the drawings to which reference is made. The words "upper" and "lower" refer to the position of inner and outer plies or layers of the base fabric according to the invention and parts thereof. The words "a" and "one" are defined as including one or more of the referenced item unless specifically stated otherwise. Terms such as "at least one" refer to one or more of the referenced items. Additionally, terms such as "at least one of A and B", as used in the claims, means "at least one of A", "at least one of B", or "at least one of A and at least one of B", with A and B generically referencing any particular items that are being recited. This terminology includes the words specifically mentioned above, derivatives thereof and words of similar import.

As used herein machine direction (MD) refers to the machine direction on a papermaking machine, and MD yarns are yarns or monofilaments which extend generally in this direction and were the warp yarns during weaving of the fabric strip. Due to the spiral wound fabric construction, such MD warp yarns are typically inclined at an angle of up to about four degrees from a true machine direction. However, for the purposes of the present disclosure, those skilled in the art will understand that the reference to MD warp yarns refers to yarns which extend generally in the machine direction regardless of the offset generated due to the spiral wound construction. Similarly, the cross-machine direction (CMD) refers to the cross machine direction on a papermaking machine, and CMD yarns are yarns that were weft yarns during weaving that extend generally in the true cross machine direction. However, the CMD yarns of the base fabric of the present invention do not extend in the true cross machine direction of the papermaking machine, but as used herein CMD is intended to also refer to the weft yarns of the base fabric which extend generally in the cross machine direction of the assembled fabric regardless of the offset generated due to the spiral wound construction.

Figure 2:
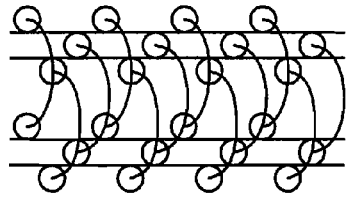
Fig. 2 ( PRIOR ART )
FIG. 2 is an end view showing seaming loops formed in the multi-axial seamed papermaking fabric in accordance with the prior art shown in FIG. 1.

Referring to FIGS. 1 and 2, a multi-axial seamed papermaking fabric in accordance with the prior art is shown. The fabric tube used to form the base fabric is folded and generally CMD extending weft yarns are removed at the fold in order to form seaming loops from the generally MD extending warp yarns. As shown in FIG. 2, this results in seaming loops that are unevenly distributed height wise across the thickness of the fabric at the seam, making seaming more difficult and potentially resulting in uneven seams. This type of construction is generally known and is presently in use in spiral wound press fabrics, and is similar to that disclosed in U.S. Pat. Nos. 6,117,274 and 6,776,878, both of which are incorporated herein by reference as if fully set forth, and which teach the formation of such multi-axial fabrics produced by spirally winding a fabric strip, flattening the fabric tube formed by the spiral winding and then removing cross wise yarns at the ends of the flattened endless loop in order to form the seaming loops.

Figure 3:
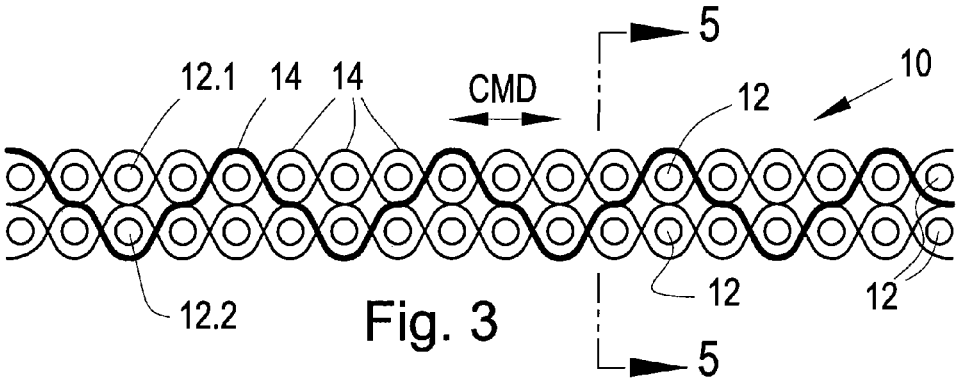
FIG. 3 is a cross-sectional view showing stacked MD warp yarns of a woven fabric strip used for making a multi-axial seamed papermaking fabric in accordance with the present invention.

Referring now to FIG. 3, a fabric strip 10 having a width less than an overall width of the desired papermaking fabric is shown along a CMD cross section to illustrate a preferred construction of the fabric strip 10. The fabric strip 10 includes a plurality of generally linearly extending vertically stacked pairs of MD warp yarns 12 interwoven with CMD weft yarns 14 in a repeat pattern. The weft yarns are arranged in order to maintain the vertically stacked alignment of the paired MD warp yarns 12. The warp yarns 12 include upper warp yarns 12.1 and lower warp yarns 12.2 that are generally vertically stacked over one another. While FIG. 3 shows an idealized drawing of this vertical stacking, those skilled in the art will recognize that some variation can occur and that it is not necessary to be exactly vertically aligned in order to have the MD warp yarns in generally vertically stacked alignment within an actual fabric construction.

Figure 11:
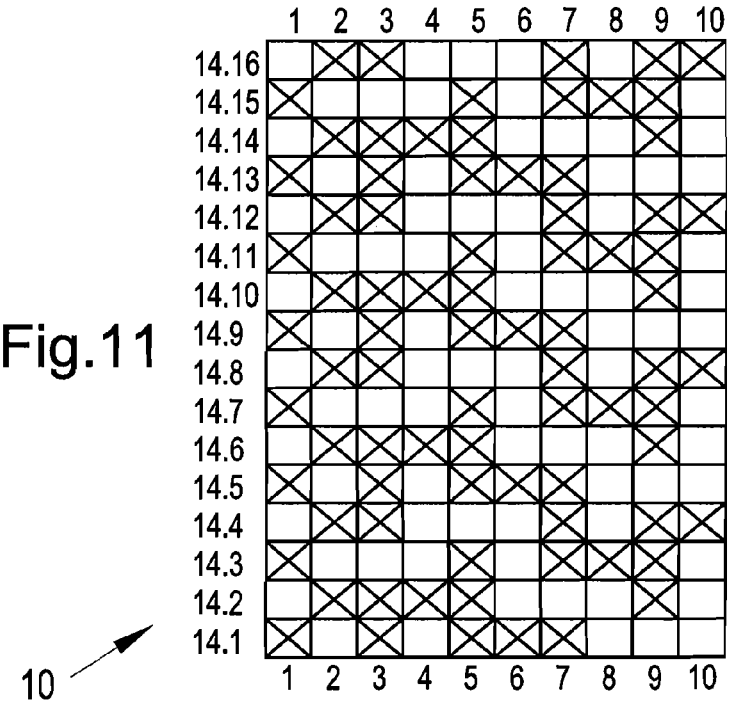
FIG. 11 is a weave diagram for a preferred base fabric in accordance with the present invention with MD yarns 1 and 2 forming a leno edge and the shaded boxes indicating which of the MD warp yarns passes over a particular CMD weft yarn for each shed.
Figure 12:
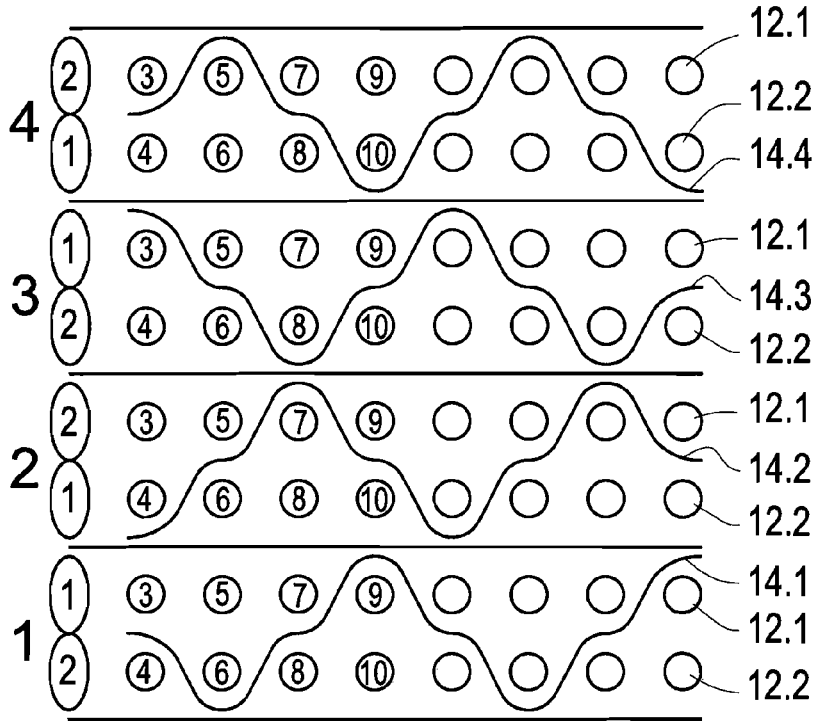
FIG. 12 is a series of cross-sectional views showing the CMD weft weave pattern for the first, second, third and fourth sheds for a four shed repeat fabric in accordance with a preferred embodiment of the invention which maintains the MD warp yarns in a generally stacked configuration.

Referring to FIGS. 11 and 12, a weave diagram which indicates a preferred weave for the fabric strip along with cross-sectional views of CMD weft yarns 14.1, 14.2, 14.3 and 14.4 are shown. As shown in FIG. 11, the edge of the fabric strip 10 preferably includes a leno weave in order to bind the CMD yarns 14.1, 14.2, 14.3, 14.4 . . . 14.16 in position at the edges of the strip 10. Preferably, the weave is a four shed repeat and weft yarns 14.5, 14.6, 14.7 and 14.8 are a repeat of weft yarns 14.1, 14.2, 14.3 and 14.4. While the upper and lower warp yarns 12.1, 12.2 are indicated in FIG. 12, the weave diagram in FIG. 11 has the warp yarns numbered in sequence along the horizontal axis, with corresponding numbering being provided on the upper and lower MD warp yarns 12.1 and 12.2 in FIG. 12. While a preferred weave pattern is shown, those skilled in the art will recognize that many other types of weaves which provide generally vertically stacked pairs of MD warp yarns 12.1, 12.2 can be utilized in accordance with the present invention.

Figure 4:
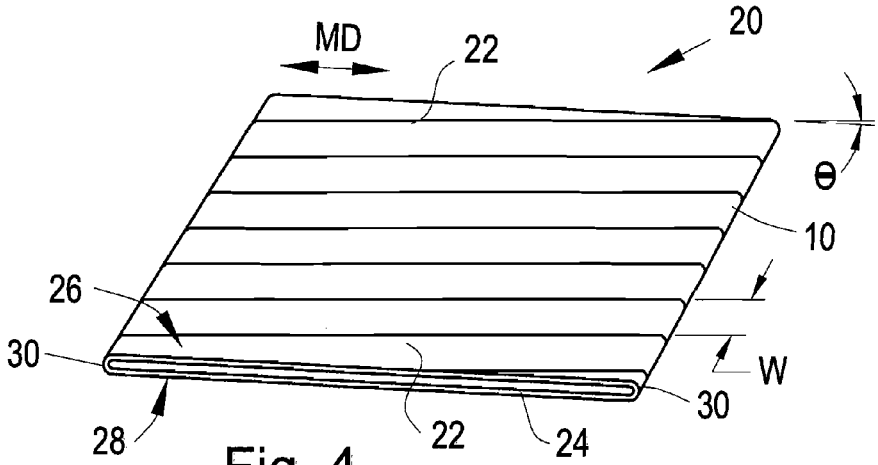
FIG. 4 is a perspective view of the spiral wound fabric strip which forms the fabric tube which is flattened to form the base fabric of the present invention

Referring now to FIG. 4, in order to form the base fabric 20 according to the present invention, the fabric strip 10, which has a width W less than an overall width of the desired papermaking fabric to be produced, is spirally wound as shown in FIG. 4 and joined together along neighboring adjacent edges 22 of the fabric strip 10 to form a fabric tube 24. In the preferred embodiment, the fabric strip 10 is spirally wound so that the MD warp yarns 12.1, 12.2 are within an angle θ of about 4° of a true machine direction. This angle can vary slightly depending upon a width of the fabric strip 10 and a length of the base fabric 20.

The outer edges of the fabric 24 are trimmed parallel to a true machine direction of the papermaking machine in which the fabric will be used. The adjacent edges 22 of the fabric strip 10 can be joined in any known manner, such as by sewing, adhesives, melting, welding, gluing, and/or any other suitable method in order to form the base fabric 20. As shown, the base fabric 20 is formed by flattening the fabric tube 24 to provide an upper layer 26 and a lower layer 28 that are adjacent to one another in the base fabric 20.

Figure 5:
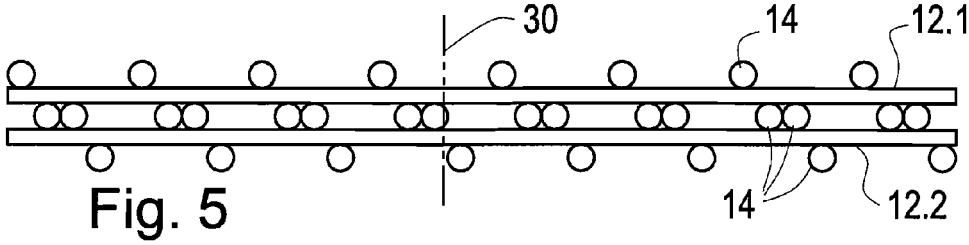
FIG. 5 is a view of the fabric strip in FIG. 3 taken along lines 5—5.
Figure 6:
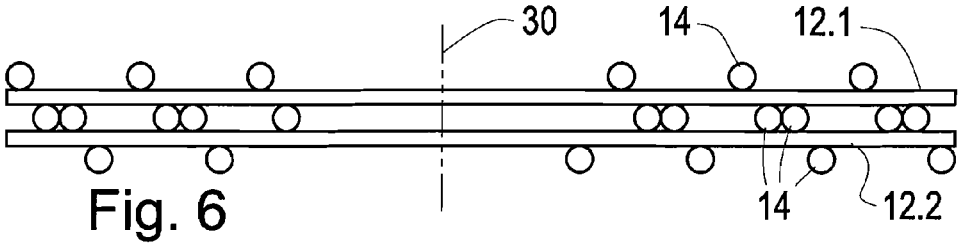
FIG. 6 is a view similar to FIG. 5 showing the weft yarns removed from the fabric strip at an end fold position in order to form the base fabric according to the present invention.

The ends of the base fabric are formed by CMD folds 30 in the fabric tube that forms the base fabric 20. Referring to FIG. 5, which shows a straightened out area of the base fabric 20 at the fold 30 in cross-section, the fold line 30 is preferably identified and marked, for example using a magic marker or other means and at least some of the CMD weft yarns 14 are removed in the area of the CMD fold 30, as shown in FIG. 6.

Figure 7:
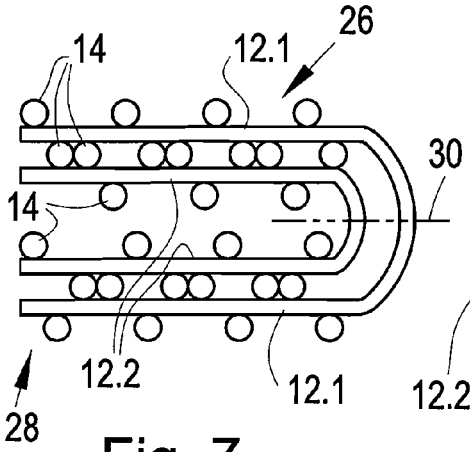
FIG. 7 is a cross-sectional view showing the fabric strip in the base fabric according to the present invention at the end fold showing the inner and outer MD warp yarns extending between the upper and lower fabric layers.
Figure 8:
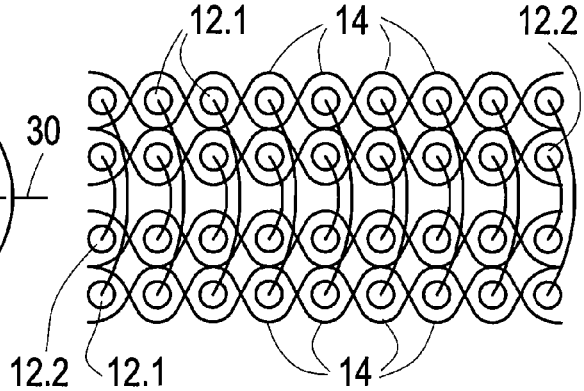
FIG. 8 is an end view of the base fabric shown in FIG. 7.

Referring to FIGS. 7 and 8, in order to complete the base fabric 20, the upper and lower layers 26, 28 are flattened to be adjacent to one another such that the MD warp yarns 12.1, 12.2 of each of the upper and lower layers 26, 28 are in a generally vertically stacked alignment within both of the layers 26, 28 adjacent to the fabric ends defined by the folds 30 to provide at least some, and preferably all, of the outer warp yarns 12.1 continuously extending between the upper and lower layers 26, 28 at the folds 30. It is also possible to provide a continuous extension of ones of the inner warp yarns 12.2 at the fold, as illustrated. Seaming loops 42 are formed from at least some of the continuously extending ones of the outer MD yarns 12.1 located at the CMD folds 30 in the fabric tube 24.

Figure 9:
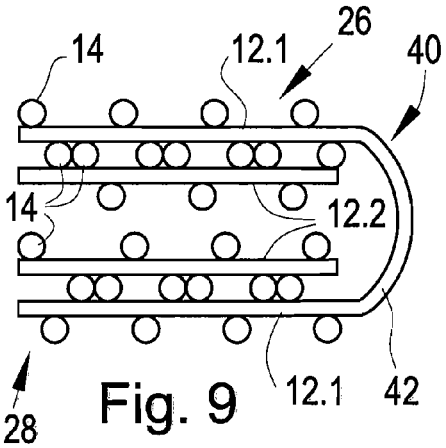
FIG. 9 is a view similar to FIG. 7 showing the removal of a portion of the inner MD warp yarns at the fold, leaving the outer MD warp yarns which form seaming loops.
Figure 10:
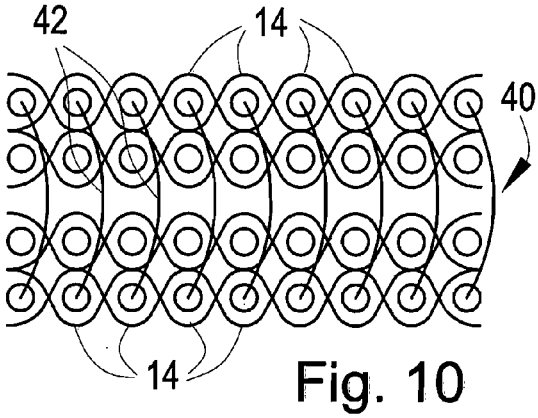
FIG. 10 is an end view of the base fabric shown in FIG. 9.

Referring to FIGS. 9 and 10, the seam 40 comprises a generally uniform row of seaming loops 42 formed at each of the folds 30 by continuous extension of outer ones of the MD warp yarns 12.1 between the upper and lower layers 26, 28 at the folds 30. Some, and preferably all of the inner ones of the MD yarns 12.2 at the folds 30 are cut back from the ends of the base fabric 20, as shown in FIG. 9. This is preferably done prior to flattening the fabric tube 24 so that the layers 26, 28 are adjacent to one another, and the illustrated configuration would generally not result in practice, and is provided for clarity and illustrative purposes only in connection with this description. However, those skilled in the art will recognize that various means can be used to remove the inner MD warp yarns at the folds.

Figure 13:
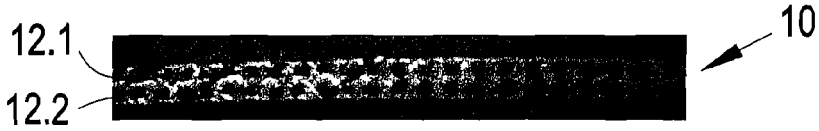
FIG. 13 is a photograph showing the stacked positions of the MD warp yarns in a sample fabric strip according to the invention.

Referring to FIG. 13, a photograph of an actual fabric strip woven in accordance with the preferred embodiment of the invention is shown. This illustrates dyed ends of the MD warp yarns 12.1, 12.2 shown in a generally vertically stacked alignment within the fabric strip 10.

Figure 14:
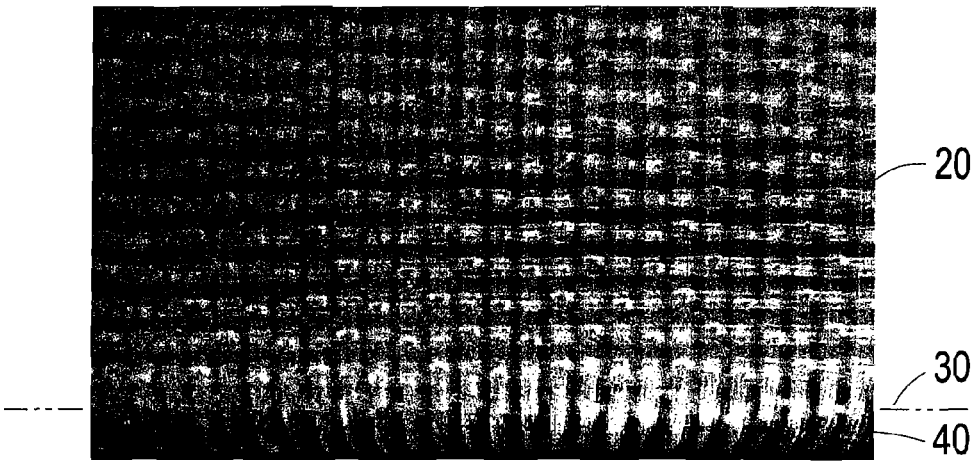
FIG. 14 is a top plan view taken from above a fold in a fabric tube formed from the fabric strip according to the invention, illustrating the generally vertically stacked MD warp yarns in the upper and lower layers which form uniform seaming loops at the fold.

FIG. 14 shows a top view photograph of the base fabric 20 at the fold 30 and the formation of the seaming loops 40 in the base fabric at the fold 30 created by removal of at least some of the CMD weft yarns at the fold and trimming back ones of the inner MD warp yarns 12.2.

Figure 15:
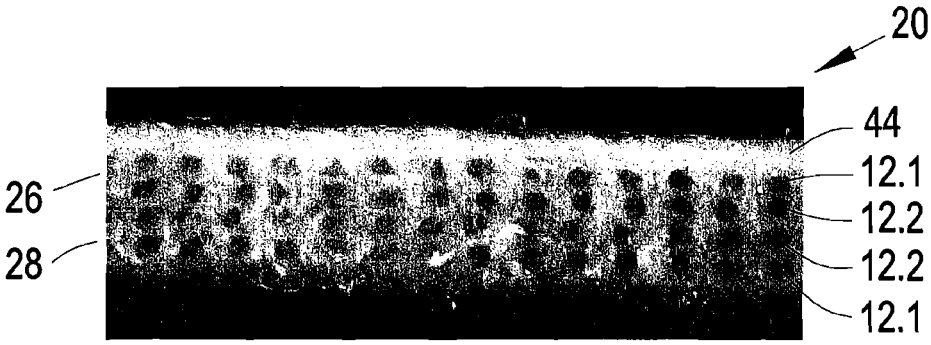
FIG. 15 is a cross-sectional view through a multi-axial seamed press felt in accordance with the invention shown after the batt has been needled to the base fabric which illustrates the generally vertically stacked alignment of the MD warp yarns of the upper and lower layers at a position near the seam forming folds at the end of the base fabric.

FIG. 15 is a photograph of an enlarged cross-section through a press felt made utilizing the base fabric 20 according to the invention. The cross-section is taken in the CMD direction adjacent to a fold 30 and shows the generally vertically stacked alignment of the MD warp yarns 12.1, 12.2 within both of the upper and lower layers 26, 28 of the base fabric 20. At least one layer of a fibrous batt material 44 is needled to the base fabric 20 in order to form a press felt for use on a papermaking machine. The upper and lower layers 26, 28 of the base fabric 20 can be joined in part by needling the batt 44 to the base fabric 20, and are preferably also joined by other means as well, such as sewing, at least in an area adjacent to the base fabric ends.

In a preferred embodiment, the MD warp yarn 12.1, 12.2 and the CMD weft yarns 14 are comprised of round monofilaments, preferably made of a polymeric material, such as nylon 6/6 or nylon 6/10, or any other suitable polymeric materials or blends or alloys thereof. In the preferred embodiment, the CMD weft yarns 14 are heavily crimped during weaving to hold the MD warp yarns 12.1, 12.2 in generally vertically stacked alignment. Preferably, the MD warp yarns are monofilaments having a diameter of about 0.2 mm to about 0.7 mm, and more preferably in the range of 0.4 mm to about 0.5 mm in diameter. The CMD weft yarns are also preferably monofilaments having a diameter of about 0.2 mm to about 0.5 mm. It has been found to be advantageous if the MD warp yarns have a larger diameter than the CMD weft yarns and in the most preferred embodiments of the invention, the MD warp yarns have a diameter of about 0.4 to about 0.5 mm and the CMD weft yarns have a diameter of about 0.3 to about 0.4 mm. It is preferred that the MD warp yarns have a diameter that is about 0.05 to about 0.2 mm greater than a diameter of the CMD weft yarns.

While the preferred embodiment of the invention utilizes a fabric strip 10 with two stacked MD warp yarns 12.1, 12.2, such that there are four generally stacked MD warp yarns 12.1, 12.2 in the base fabric 20 adjacent to the ends, those skilled in the art will recognize that other fabric weaves can be utilized in which there are more than four generally stacked MD warp yarns 12 in the completed base fabric 20.

The present invention also provides a method for forming a spiral wound, multi-axial seamed papermaking fabric. The method comprises weaving a fabric strip 10 which includes vertically stacked, paired, generally linearly extending MD warp yarns 12.1, 12.2 interwoven with CMD weft yarns 14 in a repeat pattern which maintains the vertically stacked alignment of the MD warp yarns. The fabric strip 10 is spirally wound, and linearly adjacent edges 22 are joined to form a fabric tube 24 having an upper layer 26 and a lower layer 28. Two generally CMD extending folds 30 are formed in the fabric tube 24 to define ends of a base fabric 20 having the upper layer 26 and the lower layer 28 in contact with one another. The generally vertically stacked, linearly extending MD warp yarns 12.1, 12.2 of both of the layers 26, 28 are in a generally vertically stacked alignment adjacent to the ends of the base fabric 20 defined by the folds 30.

Preferably, at least some of the CMD weft yarns 14 at the fold 30 are removed so as to expose a continuous extension of at least some of the outer ones of the MD warp yarns 12.1 between the upper and lower layers 26, 28.

In the preferred embodiment, the CMD weft yarns 14 are cut into pieces to remove the CMD weft yarns at the fold 30. This can be accomplished using a nibbler, such as that disclosed in U.S. Pat. No. 6,634,068, which is incorporated by reference herein as if fully set forth. However, those skilled in the art will recognize that other means can be utilized in order to remove the CMD weft yarns at the folds 30.

Figure 16:
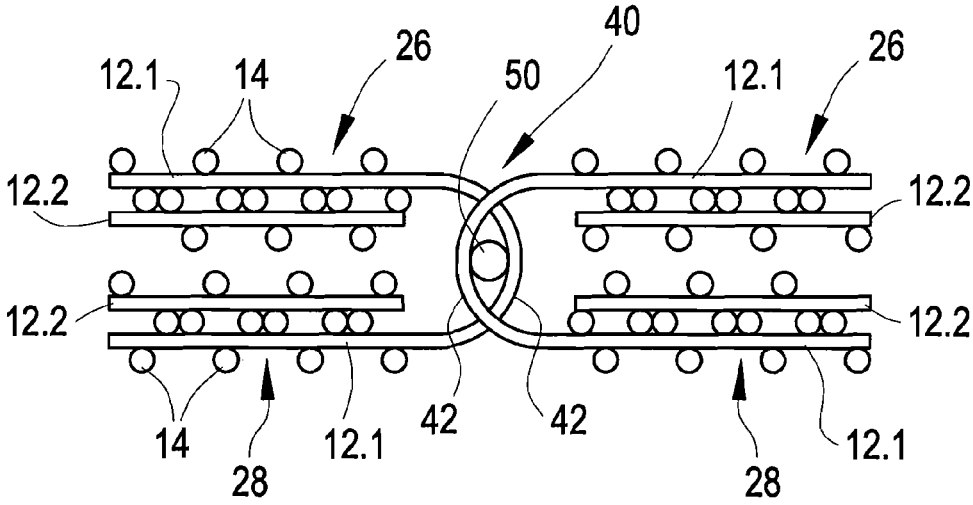
FIG. 16 is a cross-sectional view of a pintle inserted through the interdigitated seaming loops from opposing ends of the fabric.

Preferably, a generally uniform row of seaming loops 40 is formed at the folds 30 by cutting and removing a portion of inner ones of the MD warp yarns 12.2 at the fold 30, leaving the continuous extension of the outer ones of the MD warp yarns 12.1 at the fold 30. The base fabric 20 can be seamed by interdigitating the seaming loops 40 from the opposing ends and inserting a pintle 50 therethrough to form an endless fabric, as shown in FIG. 16.

While the preferred monofilaments used for the MD warp yarns 12.1, 12.2 and the CMD weft yarns 14 are monofilaments with a round cross section, it is also possible to use monofilaments having an oval or flattened cross-section or other desired shapes depending upon the particular application. Additionally, the use of a flattened cross-section yarn could provide for additional fabric stability and maintain the generally vertically stacked alignment of the MD warp yarns 12.1, 12.2.

While the preferred embodiment of the base fabric 20 according to the invention is used to form a seamed press felt for a press section of a papermaking machine, those skilled in the art will recognize that the base fabric could be used for other applications.

The press felt according to the invention is characterized by a high void volume and ease of installation and removal from the press section of a papermaking machine due to the generally uniform seaming loops formed by the MD warp yarns which are at generally uniform heights within the thickness of the base fabric 20.

It will be recognized by those of ordinary skill in the art from this disclosure that changes can be made to the above-described invention without departing from the broad inventive concept thereof. It is understood, therefore, that this invention is not limited to the particular embodiment disclosed, but is intended to cover all modifications which are within the scope and spirit of the present invention with respect to the formation of a spirally wound multi-axial base fabric or papermaker's fabric in which generally vertically stacked MD warp yarns are used to form a uniform row of seaming loops to allow for easier seaming of such fabrics by the insertion of a pintle through the interdigitated seaming loops on opposing ends of the fabric. Accordingly, the scope of the invention is defined by the appended claims.

The invention claimed is:

1. A multi-axial seamed papermaking fabric, comprising a base fabric formed from a spirally wound fabric strip having a width less than an overall width of the papermaking fabric and joined together along neighboring adjacent edges of the strip to form a fabric tube, the fabric strip comprising a plurality of generally linearly extending vertically stacked pairs of machine direction (MD) warp yarns interwoven with cross-machine direction (CMD) weft yarns in a repeat pattern which maintains the vertically stacked alignment of the paired MD warp yarns, the fabric tube includes an upper layer and a lower layer formed from the spirally wound fabric strip that are adjacent to one another in the base fabric, and ends of the base fabric are formed by CMD folds in the fabric tube, the MD warp yarns of each of the upper and lower layers being in a generally vertically stacked alignment within both of the layers adjacent to the ends to provide at least some continuously extending ones of the outer warp yarns between the upper and lower layers at the folds, and seaming loops formed from at least some of the continuously extending ones of the outer MD yarns located at the CMD folds in the fabric tube.

2. The multi-axial seamed papermaking fabric of claim 1, further including at least one layer of fibrous batt material attached to at least one planar surface of the fabric.

3. The multi-axial seamed papermaking fabric of claim 1, further comprising a seam formed from a generally uniform row of the seaming loops at each of the folds being interdigitated and a pintle inserted through the seaming loops.

4. The multi-axial seamed papermaking fabric of claim 3, further comprising:

the inner ones of the MD warp yarns at the folds are cut back from the base fabric ends.

5. The multi-axial seamed papermaking fabric of claim 1 wherein the MD warp yarns of the upper layer extend at an angle to the MD warp yarns of the lower layer, and the MD warp yarns of both layers are within about 4° or less of a true machine direction.

6. The multi-axial seamed papermaking fabric of claim 1, further comprising round monofilaments in the base fabric

7. The multi-axial seamed papermaking fabric of claim 6, further comprising:

the CMD weft yarns are crimped during weaving to hold the MD warp yarns in vertically stacked alignment.

8. The multi-axial seamed papermaking fabric of claim 1, further comprising:

the MD warp yarns are monofilaments having a diameter of about 0.2 mm to about 0.7 mm, and the CMD weft yarns are monofilaments having a diameter of about 0.2 mm to about 0.5 mm.

9. The multi-axial seamed papermaking fabric of claim 8, further comprising:

the MD warp yarns have a larger diameter than the CMD weft yarns.

10. The multi-axial seamed papermaking fabric of claim 9, further comprising:

the MD warp yarns have a diameter that is from about 0.05 mm to about 0.2 mm greater than a diameter of the CMD weft yarns.

11. The multi-axial seamed papermaking fabric of claim 1, wherein there are at least four generally vertically stacked MD warp yarns in the base fabric.

12. The multi-axial seamed papermaking fabric of claim 1, further comprising:

a batt connected to the base fabric.

13. Method of forming a spiral wound, multi-axial seamed papermaking fabric, comprising:

weaving a fabric strip which includes vertically stacked, paired, generally linearly extending machine direction (MD) warp yarns interwoven with cross-machine direction (CMD) weft yarns in a repeat pattern which maintains the generally vertically stacked alignment of the MD warp yarns;

spirally winding and joining linearly adjacent edges of the fabric strip to form a fabric tube having an upper layer and a lower layer; and forming two generally CMD extending folds in the fabric tube to define ends of a base fabric having the upper layer and the lower layer in contact with one another, the plurality of paired generally linearly extending MD warp yarns in both of the layers being in a generally vertically stacked alignment adjacent to the ends.

14. Method of forming a spiral wound, multi-axial seamed papermaking fabric of claim 13, further comprising:

removing at least some of the CMD weft yarns at the fold so as to expose a continuous extension of at least outer ones of the MD warp yarns between the upper and lower layers.

15. Method of forming a spiral wound, multi-axial seamed papermaking fabric of claim 14, further comprising cutting the CMD weft yarns into pieces to remove the CMD weft yarns at the fold.

16. Method of forming a spiral wound, multi-axial seamed papermaking fabric of claim 14, further comprising:

forming a generally uniform row of seaming loops at the fold by cutting and removing a portion of inner ones of the MD warp yarns at the fold, leaving the continuous extension of the outer ones of the MD warp yarns at the fold.

17. Method of forming a spiral wound, multi-axial seamed papermaking fabric of claim 13, further comprising providing the fabric strip with the MD warp yarns having a diameter of about 0.2 mm to about 0.7 mm, and the CMD weft yarns having a diameter of about 0.2 mm to about 0.5 mm.

18. Method of forming a spiral wound, multi-axial seamed papermaking fabric of claim 13, further comprising using monofilaments for the MD warp yarns and the CMD weft yarns.

19. Method of forming a spiral wound, multi-axial seamed papermaking fabric of claim 18, wherein the monofilaments have a circular cross-section.

20. Method of forming a spiral wound, multi-axial seamed papermaking fabric of claim 13, wherein the monofilaments have an oval or flattened cross-section.

21. A base fabric for use in a papermakers fabric, comprising:

a spirally wound fabric strip having a width less than an overall width of the base fabric and joined together along neighboring adjacent edges of the strip to form a fabric tube, the fabric strip comprising a plurality of generally linearly extending vertically stacked pairs of machine direction (MD) warp yarns interwoven with cross-machine direction (CMD) weft yarns in a repeat pattern which maintains the vertically stacked alignment of the paired MD warp yarns, the fabric tube includes an upper layer and a lower layer formed from the fabric strip that are adjacent to one another in the base fabric, and ends of the base fabric are formed by CMD folds in the fabric tube, the MD warp yarns of each of the upper and lower layers being in a generally vertically stacked alignment within both of the layers adjacent to the ends to provide at least some continuously extending ones of the outer MD warp yarns between the upper and lower layers at the folds, and seaming loops formed from at least some of the continuously extending outer MD yarns located at the CMD folds in the fabric tube.

* * * * *